US008191488B2

(12) United States Patent
Sacco

(10) Patent No.: US 8,191,488 B2
(45) Date of Patent: Jun. 5, 2012

(54) RECONFIGURABLE SUPPORT LEG

(76) Inventor: Ed Sacco, Philadelphia, PA (US)

( * ) Notice: Subject to any disclaimer, the term of this patent is extended or adjusted under 35 U.S.C. 154(b) by 0 days.

(21) Appl. No.: 12/878,452

(22) Filed: Sep. 9, 2010

(65) Prior Publication Data

US 2011/0056414 A1 Mar. 10, 2011

Related U.S. Application Data

(60) Provisional application No. 61/240,784, filed on Sep. 9, 2009.

(51) Int. Cl.
*A47B 13/00* (2006.01)

(52) U.S. Cl. ..... 108/158.12; 108/153.1; 108/158.11; 108/180; 108/192; 248/188

(58) Field of Classification Search ..... 108/158.12, 108/156, 180, 148, 147.16, 147.15, 147.13, 108/147.14, 147.17, 159, 192, 193, 157.14, 108/157.18, 157.17, 157.15, 157.16, 153.1; 248/188, 188.1; 312/263; 52/204.57
See application file for complete search history.

(56) References Cited

U.S. PATENT DOCUMENTS

| | | | | | |
|---|---|---|---|---|---|
| 206,234 | A | * | 7/1878 | Hall | 248/188 |
| 430,111 | A | * | 6/1890 | Carl | 248/188 |
| 533,766 | A | * | 2/1895 | Williams | 108/156 |
| 798,017 | A | * | 8/1905 | Davidson | 52/204.57 |
| 805,993 | A | * | 11/1905 | Petz | 52/204.57 |
| 1,605,597 | A | * | 11/1926 | Long | 312/140 |
| 2,657,964 | A | | 11/1953 | Watrous | |
| 2,686,096 | A | | 8/1954 | Barnes | |
| RE2,610 | E | | 11/1966 | Guillon et al. | |
| RE26,105 | E | * | 11/1966 | Guillon et al. | 312/263 |
| 3,574,433 | A | * | 4/1971 | Bell | 312/111 |
| 4,039,133 | A | * | 8/1977 | Streicher | 108/158.11 |
| 4,163,537 | A | * | 8/1979 | Mourgue | 248/188.1 |
| 4,585,365 | A | | 4/1986 | Manno | |
| 4,607,972 | A | * | 8/1986 | Hennick | 248/188 |
| 5,163,373 | A | * | 11/1992 | Anderson et al. | 108/158.12 |
| 6,763,770 | B2 | | 7/2004 | Marrujo | |
| 7,255,511 | B2 | | 8/2007 | Dolan | |
| 7,703,737 | B2 | * | 4/2010 | Petrick et al. | 248/407 |
| 2003/0205180 | A1 | | 11/2003 | Bishop | |

FOREIGN PATENT DOCUMENTS

| | | |
|---|---|---|
| EP | 1 077 038 A1 | 2/2001 |

* cited by examiner

*Primary Examiner* — Jose V Chen
(74) *Attorney, Agent, or Firm* — Panitch Schwarze Belisario & Nadel LLP

(57) ABSTRACT

A support leg for a table includes a rod having a first end and an opposing second end. The rod includes a first groove that extends into the rod from an outer surface of the rod toward a geometric center of the rod. The first groove extends generally parallel to a central longitudinal axis of the rod and is sized and shaped to receive at least a portion of a first side panel of the table. The rod includes a second groove spaced-apart from the first groove along the outer surface of the rod. The second groove extends into the rod from the outer surface of the rod toward the geometric center of the rod. The second groove extends generally parallel to the central longitudinal axis and is sized and shaped to receive at least a portion of a second side panel of the table.

14 Claims, 6 Drawing Sheets

RECONFIGURABLE SUPPORT LEG

CROSS-REFERENCE TO RELATED APPLICATIONS

The present application claims priority to U.S. Provisional Patent Application No. 61/210,784, filed Sep. 9, 2009 and entitled "Reconfigurable Support Leg."

BACKGROUND OF THE INVENTION

Embodiments of the present invention are directed to a reconfigurable support leg and, more specifically, to one or more support legs for a support structure, such as a table, that are reconfigurable to allow a manufacturer or user to quickly and easily redimension and/or rearrange the shape and/or size of the support structure and quickly and easily assemble and/or disassemble the same.

Support structures, such as tables, desks, cabinets, furniture, chairs, medical examination tables, slot machine bases, etc., are well known. However, conventional support structures can be relatively large, cumbersome and are typically designed to function in a single configuration. Such support structures can be difficult and/or time-consuming to assemble and/or disassemble. Further, conventional support structures are typically not able to accommodate a user's desire to modify the purpose of the support structure by modifying its configuration or arrangement.

Therefore, it would be desirable to create one or more support legs for a support structure, such as a table, that are sized and shaped to allow a user to assemble and/or disassemble the support structure. Specifically, it would be desirable to create a support leg that includes one or more grooves that are sized and shaped to receive at least a portion of the support structure to quickly and easily reconfigure, assemble and/or disassemble the support structure. Further, it would be desirable to create a reconfigurable table having at least three support legs, such that the table can be reconfigured into various sizes, shapes and/or angles to accommodate the user's needs.

BRIEF SUMMARY OF THE INVENTION

Briefly stated, preferred embodiments of the present invention are directed to a support leg for a table. The support leg includes a rod having a first end and an opposing second end. The rod defines an imaginary central longitudinal axis that extends from the first end to the second end. The first end of the rod is configured to support the leg on a supporting surface and the second end of the rod extends upwardly away from the first end and the supporting surface. The rod includes a first groove that extends into the rod from an outer surface of the rod toward a geometric center of the rod. The first groove extends generally parallel to the imaginary central longitudinal axis and is sized and shaped to receive at least a portion of a first side panel of the table. The rod includes a second groove spaced-apart from the first groove along the outer surface of the rod. The second groove extends into the rod from the outer surface of the rod toward the geometric center of the rod. The second groove extends generally parallel to the imaginary central longitudinal axis and is sized and shaped to receive at least a portion of a second side panel of the table. The first groove has a shorter length, as measured along the imaginary central longitudinal axis, than the second groove.

In another aspect, preferred embodiments of the present invention are directed to a table having four spaced-apart support legs, a pair of first side panels, a pair of second side panels, and a top panel. Each support leg includes a rod having a first end and an opposing second end. The rod defines an imaginary central longitudinal axis that extends from the first end to the second end. The first end is configured to support the leg on a supporting surface and the second end extends upwardly away from the first end and the supporting surface, The rod includes a first groove that extends into the rod from an outer surface of the rod toward a geometric center of the rod. The first groove extends generally parallel to the imaginary central longitudinal axis and is sized and shaped to receive at least a portion of one of the first side panels of the table. The rod includes a second groove spaced-apart from the first groove along the outer surface of the rod. The second groove extends into the rod from the outer surface of the rod toward the geometric center of the rod. The second groove extends generally parallel to the imaginary central longitudinal axis and is sized and shaped to receive at least a portion of one of the second side panels of the table. The first groove having a shorter length, as measured along the imaginary central longitudinal axis, than the second groove.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
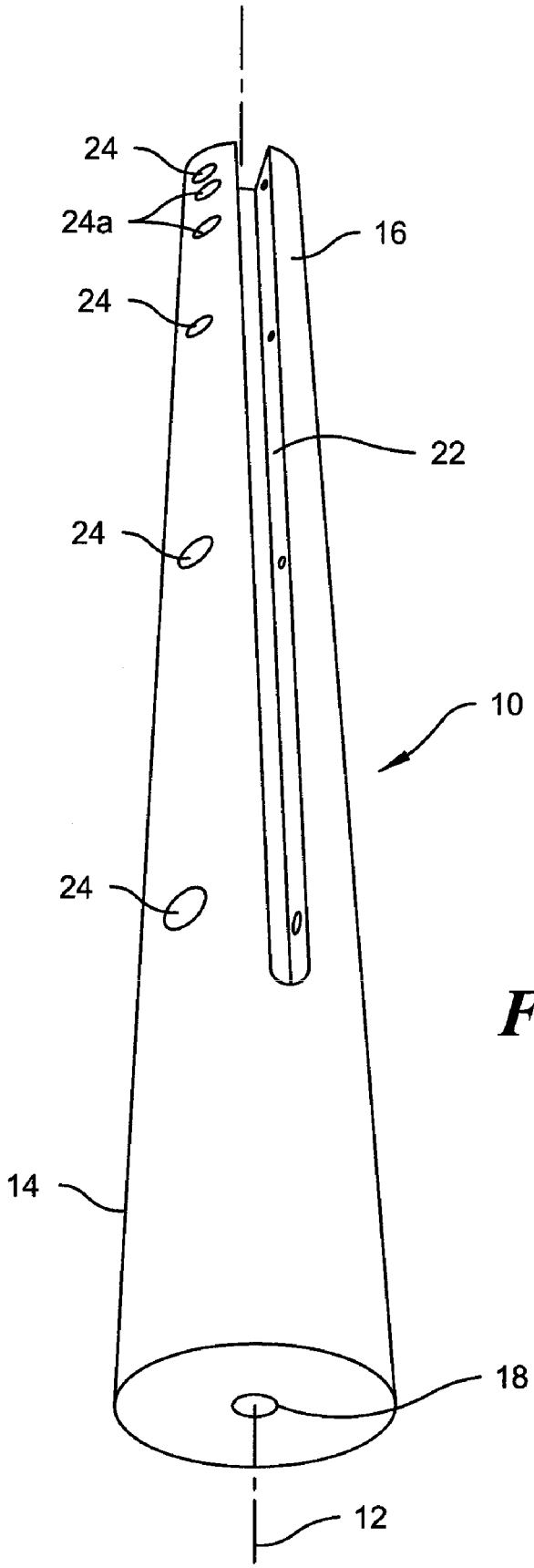
FIG. 1 is a bottom perspective view of a support leg in accordance with a preferred embodiment of the present invention.
Figure 2:
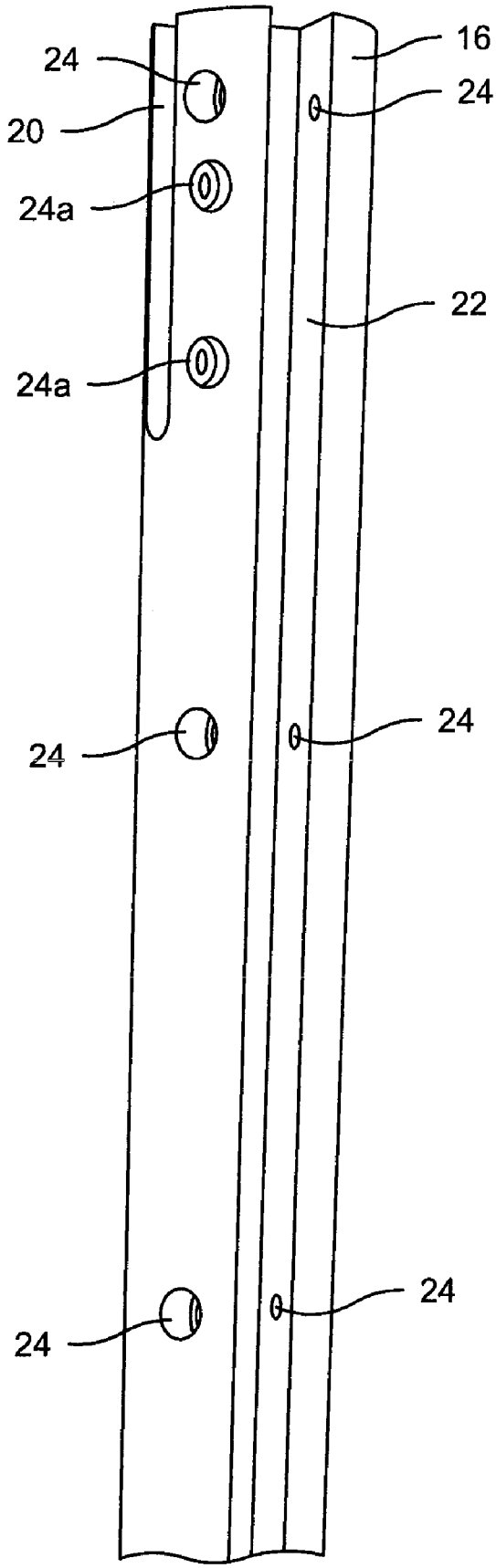
FIG. 2 is a perspective view of a second or top end of the support leg shown in FIG. 1.
Figure 3:
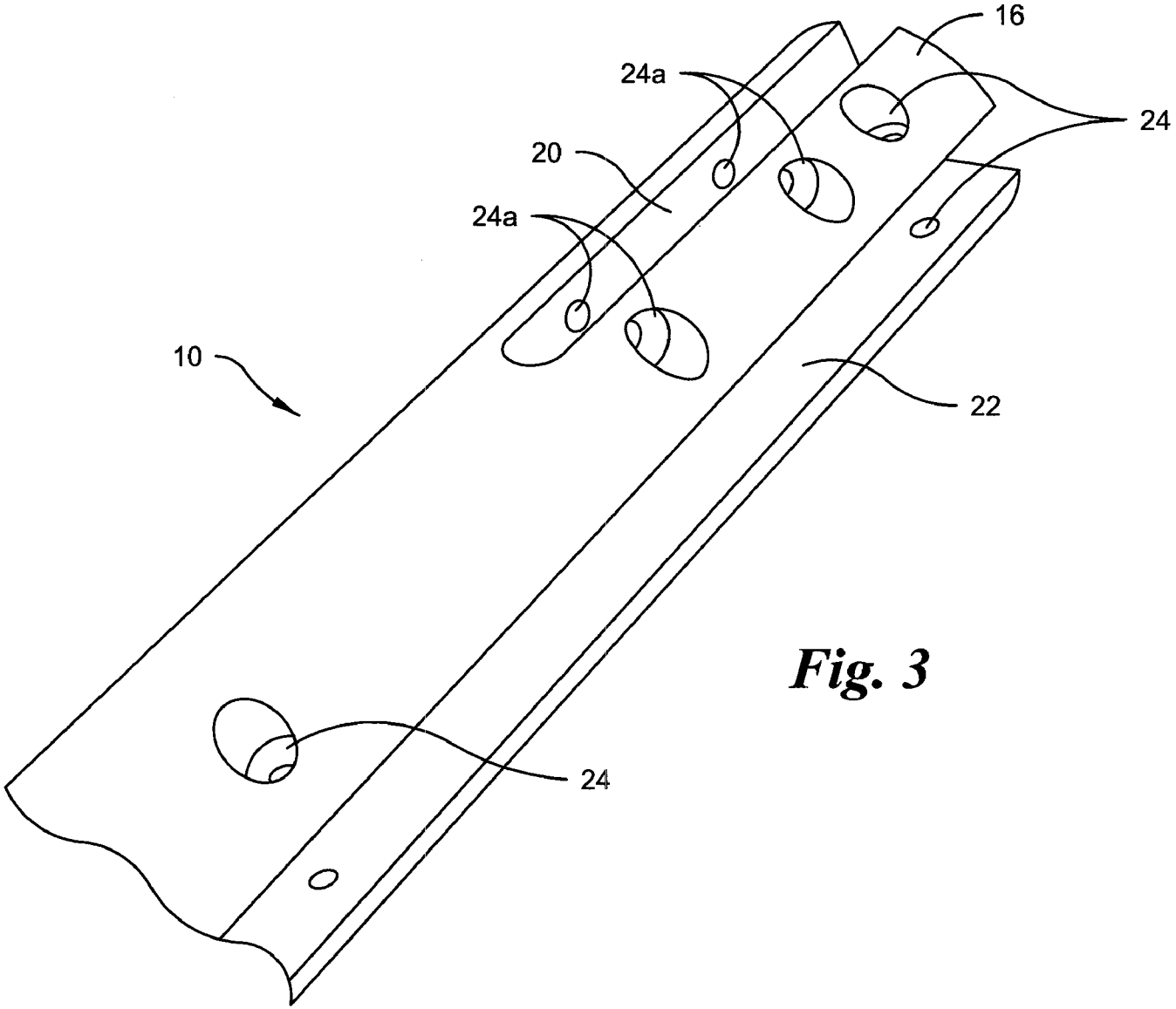
FIG. 3 is a magnified perspective view of the second or top end of the support leg shown in FIG. 1, as seen from an alternative angle from that shown in FIG. 2.
Figure 4:
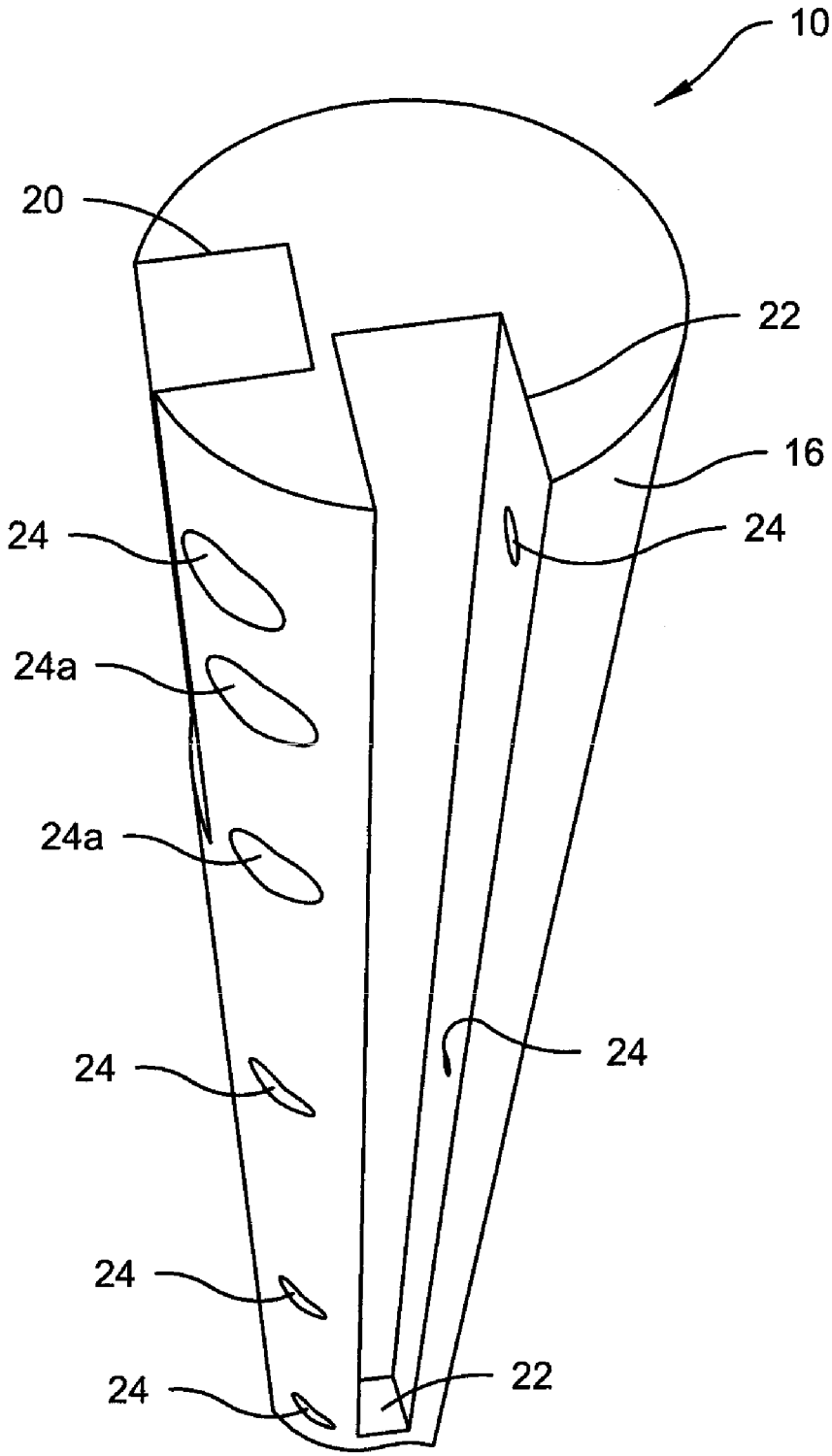
FIG. 4 is a top perspective view of the second or top end of the support leg shown in FIG. 1.
Figure 5:
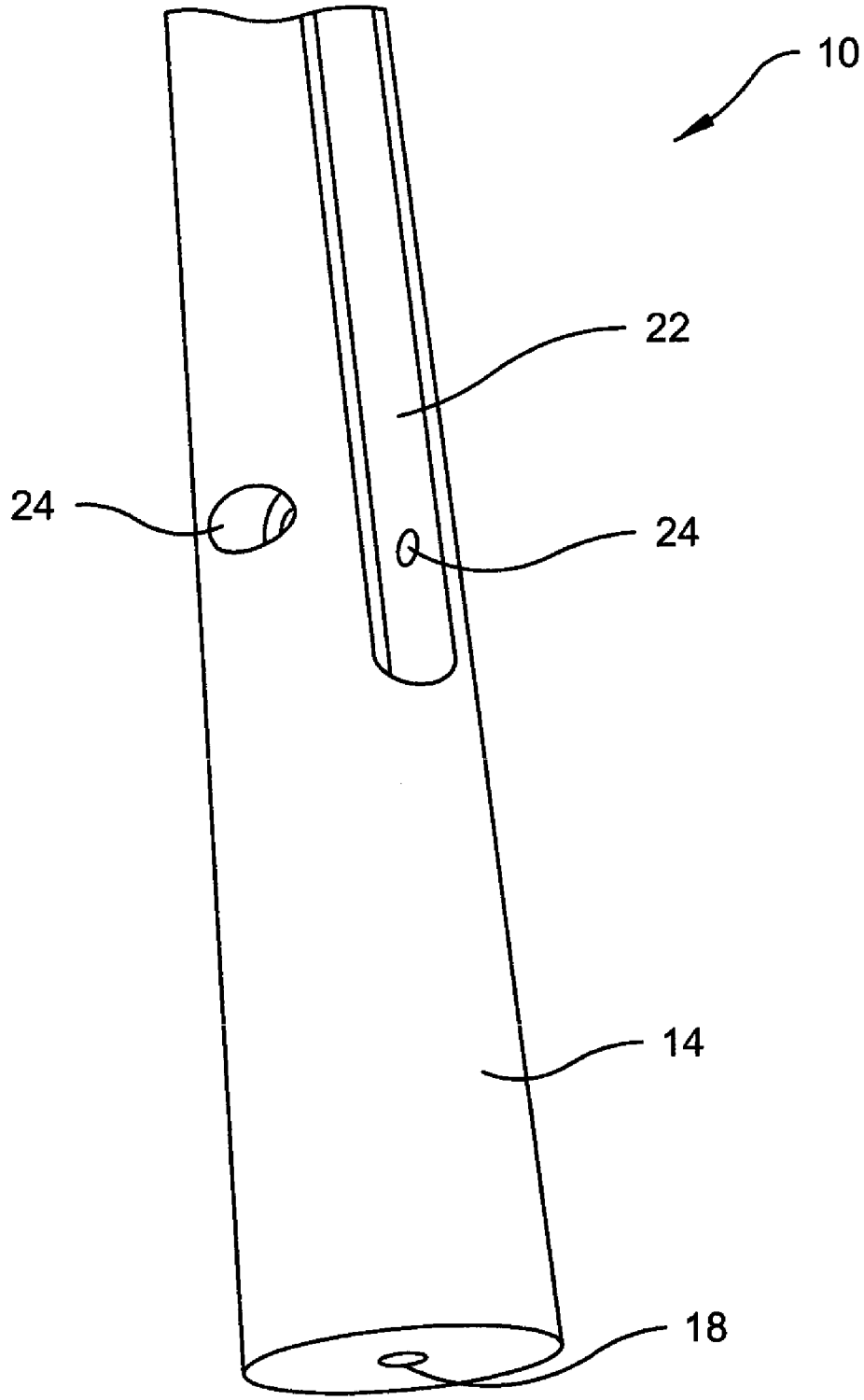
FIG. 5 is a perspective view of a first or lower end of the support leg shown in FIG. 1.

Certain terminology is used in the following description for convenience only and is not limiting. The words "right," "left," "lower" and "upper" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the leg(s), support structure, and designated parts thereof. Additionally, the term "a," "an,"

and "the," as used in the specification, mean "at least one." The terminology includes the words above specifically mentioned, derivatives thereof, and words of similar import.

Referring to the drawings in detail, wherein like numerals indicate like elements throughout, there is shown in FIGS. 1-8 a preferred embodiment of a reconfigurable support leg, generally designated 10 and hereinafter referred to as the "leg" 10, in accordance with a preferred embodiment of the present invention. The leg 10 is preferable sized and shaped to support a support structure 80 (FIG. 6), such as a table, for example a casino table or blackjack table, a desk, a cabinet, a piece of furniture, a chair, a slot machine base, etc., on a support surface 82 (FIG. 6), such as the ground surface. In the preferred embodiment, the support structure 80 is a table made of several generally planar pieces of wood or metal, for example, that are supported a predetermined distance above the ground surface 82 by four spaced-apart legs 10 as described herein. However, it is understood by those skilled in the art that one or more legs 10 can support a support structure of any size and/or shape above the support surface 82. For example, at least a portion of the support structure 80, such as a generally vertically side portion, may include drawers, cabinets and/or slots.

Referring to FIG. 1, the leg 10 is generally in form of a rod or shaft that defines an imaginary central longitudinal axis 12 that extends from a first or lower end 14 of the leg 10 to an opposing second or upper end 16 of the leg 10. The leg 10 is preferably solid and may be generally circular in cross-sectional area and may define a generally equal and/or smooth outer surface or circumference along the entire length thereof. However, the leg 10 is not limited to such a configuration, as the leg 10 may be circular, ellipsoidal, ovular, square, rectangular, triangular, diamond, multi-faceted or any other shape in cross-section.

As shown in FIG. 1, a lower most end portion of the first or lower end 14 of the leg 10 includes an aperture or bore 18 that is sized and shaped to receive a fastening member (not shown), such as pin, screw or glide member, which may engage a track or rail (not shown) supported on the support surface 82 or may directly contact the support surface 82. Thus, one of more of the legs 10 may be positioned generally perpendicularly with respect to the track or rail to support the support structure 80 above the support surface 82. Alternatively, the lower most end of the first or lower end 14 or the glide member, such as a ball bearing or a roller, may be in direct facing engagement with the support surface 82. The bore 18 is preferably located in the geometric center of the first end 14 and the bore 18 may be threaded, but it is not limited to such a configuration. Thus, the first end 14 is configured to support the leg 10 on the support surface 82 and the second end 16 extends upwardly from the first end 14 when the leg 10 is in the use configuration to support the support structure 80 above the support surface 82.

In the present embodiment, the leg 10 is formed of a high-strength, light-weight material, such as aluminum. However, the leg 10 may be formed of virtually any material that is capable of achieving the functions of the leg 10 described herein. Preferably, the leg 10 is a generally solid structure. However, the leg 10 may include one or more hollow portions therein to generally reduce the overall weight of the leg 10 and reduce the amount of material needed to machine or produce the leg 10.)

Figures 6, 7, 8:
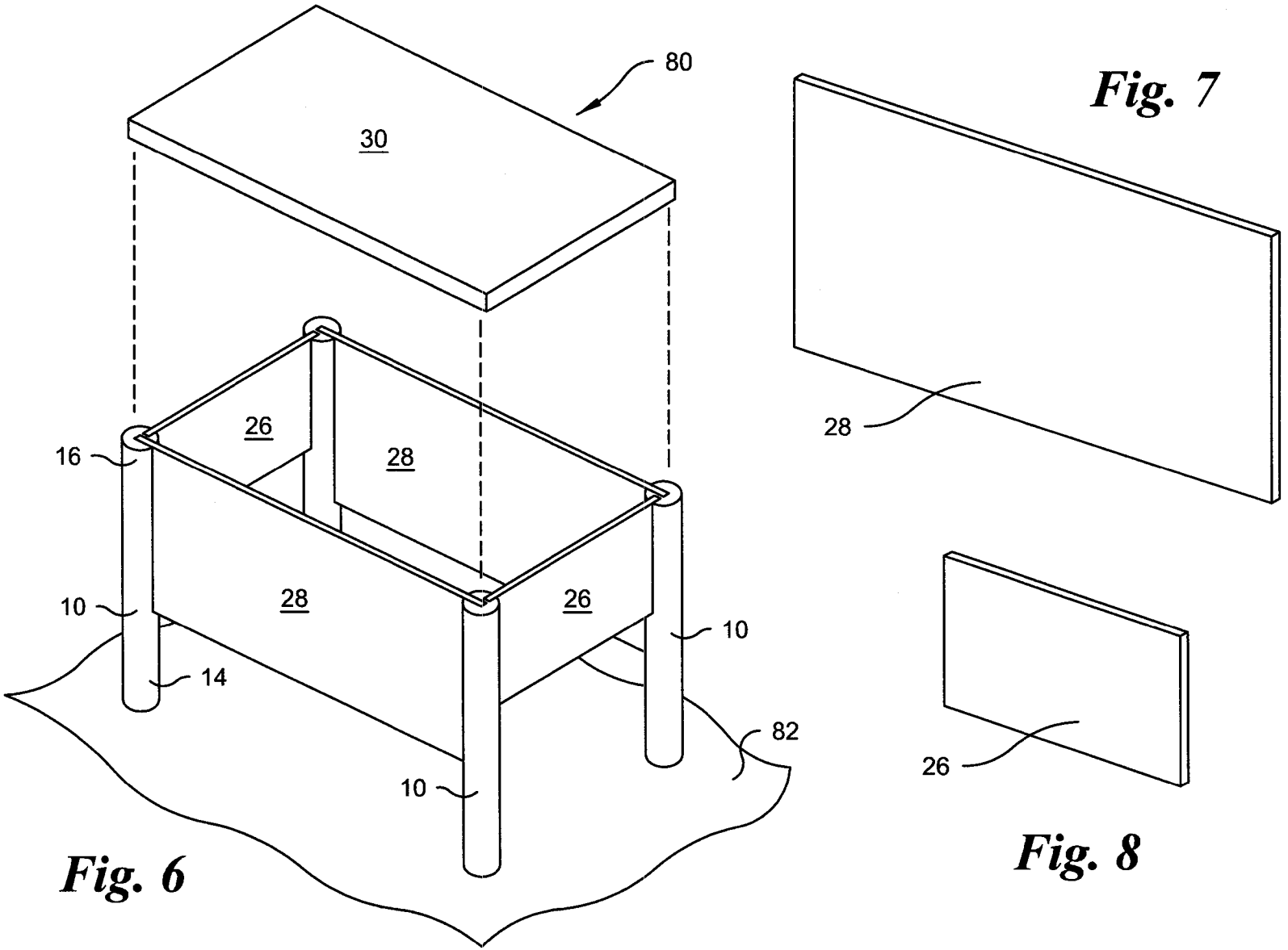
FIG. 6 is a perspective view of a support structure having a plurality of support legs in accordance with a preferred embodiment of the present invention.
FIG. 7 is a magnified perspective view of a panel or side of the support structure in accordance with a preferred embodiment of the present invention.
FIG. 8 is a magnified perspective view of another panel or side of the support structure in accordance with a preferred embodiment of the present invention.

Referring to FIGS. 1-5, the leg 10 preferably includes a first groove or socket 20 that extends into a geometric center of the leg 10 from the outer circumference thereof. The first groove 20 preferably extends at least generally parallel to the imaginary central longitudinal axis 12, but the first groove 20 is not so limited, as the first groove 20 may extend at least generally perpendicular to the imaginary central longitudinal axis 12. The first groove 20 is preferably sized and shaped to receive at least a portion of a first panel or side 26 (FIGS. 7 and 8), such as a modesty panel, of the support structure 80. The first panel 26 may be generally planar and rectangular in shape with a predetermined thickness. However, the first panel 26 is not limited to such configuration, as the first panel 26 may have virtually any size or shape and may include a drawer or cabinet, for example. In the present embodiment, the first groove 20 begins at the second end 16 of the leg 10 and has a length of approximately 4½ inches, as measured along the imaginary central longitudinal axis 12 from the second end 16 of the leg 10 toward the first end 14 of the leg 10. As seen in FIG. 7, the first groove 20 has a generally square-shaped cross-section throughout its length. However, the preferred length and shape of the first groove 20 may be modified by a manufacturer, for example, to produce a support structure 80 of various sizes, shapes and attributes.

The leg 10 further preferably includes a second groove or socket 22 that is spaced-apart from the first groove 20 along the outer surface or circumference of the leg 10. The second groove 22 preferably inwardly toward the geometric center of the leg 10 from the outer circumference thereof. The second groove 22 preferably extends at least generally parallel to the imaginary central longitudinal axis 12, but the second groove 22 is not so limited, as the second groove 22 may extend at least generally perpendicular to the imaginary central longitudinal axis 12. The second groove 22 is sized and shaped to receive a second panel or side 28 (FIGS. 9 and 10) of the support structure 80, which, in the present embodiment, has a greater cross-sectional area than the first panel 26 and is preferably similar in shape to the first panel 26. In the present embodiment, the second groove 22 begins at the second end 16 of the leg 10 and has a length of approximately 24 inches, as measured along the longitudinal access 12 from the second end 16 of the leg 10 toward the first end 14 of the leg 10. As seen in FIG. 7, the second groove 22 has a generally square-shaped cross-section throughout its length. Further, the second groove 22 preferably extends further into the interior of the leg 10 then the first groove 20, thus providing greater stability to the generally larger second panel 28. Thus, the first groove 20 has a shorter length, as measured along the longitudinal access, then the second groove 22. However, the preferred length and shape of the second groove 22 may be modified to produce a support structure 80 of various sizes, shapes and attributes.

Referring again to FIGS. 1-5, the leg 10 includes a plurality of spaced-apart holes 24 that extend inwardly from the outer surface or circumference of the leg 10 into one of the two grooves 20, 22. The holes 24 are preferably counter-sunk machined holes that are generally sized and shaped to receive a fastener, such as a screw, bolt or peg, for example, to engage and securely hold one panel within each groove 20, 22. As seen in FIG. 1, four of the holes 24 are generally aligned along a common plane, are generally equally-spaced-apart along the length of the second groove 22 and extend into the second groove 22. As seen in FIGS. 1-7, at least two additional holes **24*a* are generally aligned in a second common plane spaced-apart from the common plane of the four holes 24 along the outer surface or circumference of the leg 10. The two additional holes 24*a* preferably extend into the first groove 20 from the outer circumference of the leg 10. It is understood by those skilled in the art that the leg 10 is not limited to the exact amount, size and spacing of the grooves 20, 22 and holes 24, 24*a***, but may be modified as deemed necessary by a manufacturer or user, for example.

In use, it is preferred that four legs 10 are spaced-apart and positioned to securely connect four individual panels or sides (see FIG. 6) of a table in a generally square or rectangular configuration. Further, it is preferred that a top surface or panel 30 (FIG. 6) is either laid across or securely fastened to the top most portion of the second end 16 of each leg 10. It is preferred that the opposing and outer most ends of each panel or side extend into and are secured within one of the grooves 20, 22 of each leg 10. Specifically, it is preferred that a larger panel or side, such as second panel 28, extends from the second groove 22 of one of the legs 10 into a second groove 22 of a second of the legs 10. This panel would then form a first sidewall of the table. A second panel or side, such a first panel 26, then preferably extends from the first groove 20 of one of the support legs 10 into the first groove 20 of another of the support legs 10. This second panel would then form a second sidewall of the table. In this configuration, the two panels or sides extend generally perpendicular to one another. To create the third and fourth sidewalls of the table, two additional panels, such as one of first and second side panels 26, 28, are likewise inserted into the first groove 20 of a remaining support leg 10 and a second groove 22 of a remaining support leg 10. Thus, the four sidewalls of the table are formed, each panel or side being perpendicular to an adjacent panel or side.

It is understood by those skilled in the art that the grooves 20, 22 and holes 24, 24*a* may be modified such that the support structure 80 can have a generally circular or oval shape, for example. Specifically, each groove 20, 22 may extend into the interior of the leg 10 at an angle, such that each panel or side 26, 28 extends outwardly from each support leg 10 at an angle. Further, each groove 20, 22 may have a generally arcuate shape to receive and support generally arcuate-shaped panels (not shown) of a generally circular or round table, for example.

The above-identified structure provides a support leg that is easily sized, shaped, redimensioned and/or reconfigured by a manufacturer, for example, to produce support structures of varying size, shape and with various features. Further, the support leg of the present embodiment provides for the creation of a support structure, such as a table, that is easily and quickly assembled, disassembled and/or reconfigurable into a variety of configurations, sizes and shapes. While conventional brackets of a table or desk can be cumbersome and time-consuming to assemble and/or disassemble, the grooves 20, 22 and holes 24, 24*a* of the support leg 10 of the present invention allow for easy assembly and/or disassembly and reduce the number of components necessary to construct the supporting structure.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A support leg for a table comprising:

a rod having a first end and an opposing second end, the rod defining an imaginary central longitudinal axis extending from the first end to the second end, the first end being configured to support the leg on a supporting surface and the second end extending upwardly away from the first end and the supporting surface;

a first groove extending into the rod from an outer surface of the rod toward a geometric center of the rod, the first groove extending generally parallel to the imaginary central longitudinal axis;

a second groove spaced-apart from the first groove along the outer surface of the rod, the second groove extending into the rod from the outer surface of the rod toward the geometric center of the rod, the second groove extending generally parallel to the imaginary central longitudinal axis, the first groove having a shorter length, as measured along the imaginary central longitudinal axis, than the second groove, the first groove extending into the rod from the outer surface of the rod toward the geometric center of the rod substantially perpendicularly to the second groove;

a plurality of holes extending inwardly from the outer surface of the rod into the second groove, the plurality of holes being spaced-apart and aligned in a common plane, each hole extending generally perpendicular to the imaginary central longitudinal axis of the rod, each hole being sized and shaped to receive a fastener therein; and at least two additional holes generally aligned in a second common plane spaced-apart from the common plane of the plurality of holes around the outer surface of the rod, the at least two additional holes being spaced-apart and extending into the first groove from the outer surface of the rod, the at least two additional holes extending substantially perpendicularly to the plurality of holes.

2. The support leg according to claim 1 wherein the rod has a cross-sectional shape of one of a circle, an ellipsoid, an oval, a square or a rectangle.

3. The support leg according to claim 1 wherein the rod is solid.

4. The support leg according to claim 1. wherein at least one the first groove and the second groove is generally square in cross-sectional shape throughout an entire length thereof.

5. The support leg according to claim 1 wherein the first end of the rod includes an aperture that extends toward the geometric center of the rod and along the imaginary central longitudinal axis, the aperture being sized and shaped to receive a fastener therein.

6. The support leg according to claim 5 wherein the plurality of holes are counter-sunk.

7. The support leg according to claim 1 wherein the rod is formed of aluminum.

8. The support leg according to claim 1 wherein both the first side panel and the second side panel are generally planar and rectangular in shape, and wherein both the first side panel and the second side panel extend generally parallel to the imaginary central longitudinal axis of the rod.

9. The support leg according to claim 1 wherein the second groove extends further into an interior of the rod than the first groove.

10. A table having four spaced-apart support legs, a pair of first side panels, a pair of second side panels, and a top panel, each support leg comprising:

a rod having a first end and an opposing second end, the rod defining an imaginary central longitudinal axis extending from the first end to the second end, the first end being configured to support the leg on a supporting surface and the second end extending upwardly away from the first end and the supporting surface;

a first groove extending into the rod from an outer surface of the rod toward a geometric center of the rod, the first groove extending generally parallel to the imaginary central longitudinal axis and being sized and shaped to receive at least a portion of one of the first side panels of the table;

a second groove spaced-apart from the first groove along the outer surface of the rod, the second groove extending into the rod from the outer surface of the rod toward the geometric center of the rod, the second groove extending generally parallel to the imaginary central longitudinal axis and being sized and shaped to receive at least a portion of one of the second side panels of the table, the first groove having a shorter length, as measured along the imaginary central longitudinal axis, than the second groove, the first groove extending into the rod from the outer surface of the rod toward the geometric center of the rod substantially perpendicularly to the second groove;

a plurality of holes extending inwardly from the outer surface of the rod into the second groove, the plurality of holes being spaced-apart and aligned in a common plane, each hole extending generally perpendicular to the imaginary central longitudinal axis of the rod, each hole being sized and shaped to receive a fastener therein; and at least two additional holes generally aligned in a second common plane spaced-apart from the common plane of the plurality of holes around the outer surface of the rod, the at least two additional holes being spaced-apart and extending into the first groove from the outer surface of the rod, the at least two additional holes extending substantially perpendicularly to the plurality of holes.

11. The table according to claim 10 wherein the four spaced-apart legs support the top panel of the table above the supporting surface, the top panel being placed on the second end of each leg.

12. The table according to claim 10 wherein the table is one of a casino table, a desk, a cabinet and a piece of furniture.

13. The table according to claim 10 wherein the second groove extends into the rod from the outer surface toward the geometric center further than the first groove.

14. The table according to claim 13 wherein the plurality of holes are counter-sunk.

* * * * *